US011389006B2

(12) United States Patent
Elliott et al.

(10) Patent No.: US 11,389,006 B2
(45) Date of Patent: Jul. 19, 2022

(54) AIR-CONDITIONED MATTRESS TOPPER

(71) Applicant: Perfectly Snug Inc., Victoria (CA)

(72) Inventors: Jason Douglas Elliott, Delta (CA); Martin Lewis Furse, Victoria (CA)

(73) Assignee: Perfectly Snug Inc., Victoria (CA)

( * ) Notice: Subject to any disclaimer, the term of this patent is extended or adjusted under 35 U.S.C. 154(b) by 170 days.

(21) Appl. No.: 16/879,339

(22) Filed: May 20, 2020

(65) Prior Publication Data

US 2020/0397148 A1 Dec. 24, 2020

Related U.S. Application Data

(60) Provisional application No. 62/862,762, filed on Jun. 18, 2019.

(51) Int. Cl.

| | |
|---|---|
| ***A47C 21/04*** | (2006.01) |
| ***A47C 27/00*** | (2006.01) |
| ***H05B 1/02*** | (2006.01) |
| ***H05B 3/34*** | (2006.01) |

(52) U.S. Cl.

CPC ..... *A47C 21/044* (2013.01); *A47C 27/002* (2013.01); *H05B 1/0272* (2013.01); *H05B 3/342* (2013.01)

(58) Field of Classification Search

CPC ... A47C 21/044; A47C 27/002; A47C 21/048; A47C 21/04; A47C 27/144; A47C 27/15; A47C 31/006; H05B 1/0272; H05B 3/342; A61G 7/05784; A61G 7/05792

See application file for complete search history.

(56) References Cited

U.S. PATENT DOCUMENTS

| | | | | |
|---|---|---|---|---|
| 4,825,488 | A * | 5/1989 | Bedford | A47C 21/044 5/726 |
| 8,782,830 | B2 | 7/2014 | Brykalski et al. | |
| 9,888,782 | B1 | 2/2018 | Jannke | |
| 10,051,973 | B2 | 8/2018 | Morgan et al. | |
| 2007/0261173 | A1* | 11/2007 | Schlussel | A47C 31/006 5/725 |
| 2007/0261548 | A1* | 11/2007 | Vrzalik | A47C 27/14 95/52 |

(Continued)

FOREIGN PATENT DOCUMENTS

| | | |
|---|---|---|
| EP | 2 628 413 | 8/2014 |
| EP | 2 741 637 | 9/2015 |

(Continued)

*Primary Examiner* — Peter M. Cuomo
*Assistant Examiner* — Alison N LaBarge
(74) *Attorney, Agent, or Firm* — Clark & Brody LP

(57) ABSTRACT

A mattress topper for providing improved comfort to a sleeper comprises a pressure distribution layer defining an interior volume. The pressure distribution layer has substantially air-impermeable side walls and a substantially air-impermeable base, and a top surface having at least a region that is air permeable. Support material is contained within the interior volume. The mattress topper includes at least one electrically powered air circulation device for drawing air into the interior volume of the pressure distribution layer via at least one air inlet port. A lateral air-flow layer is disposed above the pressure distribution layer and is configured to provide substantially unimpeded air flow both upwardly and laterally.

19 Claims, 10 Drawing Sheets

(56) References Cited

U.S. PATENT DOCUMENTS

| | | | | |
|---|---|---|---|---|
| 2011/0289684 | A1 | 12/2011 | Parish et al. | |
| 2014/0182061 | A1* | 7/2014 | Zaiss | A61G 7/05792 5/423 |
| 2014/0366277 | A1* | 12/2014 | Niederkrom | A61G 7/05792 5/691 |
| 2015/0216315 | A1* | 8/2015 | Luckemeyer | A61G 7/05784 5/423 |
| 2015/0296992 | A1* | 10/2015 | Ghanei | A47C 21/044 5/423 |
| 2018/0027981 | A1* | 2/2018 | Sherman | A47C 27/18 |
| 2018/0271300 | A1 | 9/2018 | Wang | |
| 2020/0338853 | A1* | 10/2020 | Mueller | B32B 5/026 |

FOREIGN PATENT DOCUMENTS

| | | | | |
|---|---|---|---|---|
| WO | 2008/098945 | | 8/2008 | |
| WO | WO-2008098945 | A2 * | 8/2008 | A47C 21/044 |

* cited by examiner

AIR-CONDITIONED MATTRESS TOPPER

This application claims priority of U.S. Provisional Application No. 62/862,762, filed on Jun. 18, 2019, the disclosure of which is incorporated by reference in its entirety.

FIELD OF THE INVENTION

The present invention relates to climate control of sleeping surfaces such as mattresses and mattress toppers, and more generally to air-conditioning of sleep environments.

BACKGROUND

Many people suffer temperature and humidity related discomfort when trying to sleep. Many people have difficulty sleeping because they feel too hot, too cold, or suffer from night sweating. Many such people do not find sufficient relief from being too hot by merely cooling the room where they sleep because the sleep surface becomes too warm where the sleeper's body rests. There are existing mattresses or other devices that provide some airflow through, or around, the sleep surface, but do not provide for cooling directly beneath the surface of the sleeper's body, where the body may block vertically-orientated air passages preventing or reducing cooling directly beneath the sleeper's body. Although there are devices intended to address this problem, there is no effective mattress topper that provides thermal and humidity amelioration in a format suitable for use upon an existing bed and mattress.

In one mattress topper, temperature-controlled liquid is directed to flow through a network of fluid-carrying channels arranged in a blanket-like layer positioned upon the mattress surface to control the temperature of the sleep surface. But although such mattresses provide surface cooling, they provide no facility for removing excess humidity and hot air from the sleep environment. The sleep environment as described herein is intended to mean the space between the sleep surface on which a sleeper lies, and the bedding (e.g. sheets and blankets or duvet) under which the sleeper typically lies.

Other devices use forced air introduced directly into and moving through the sleep environment, or over the sleeper, to effect thermal and humidity amelioration, but do not cool the surface beneath the sleeper. The sleeper in this case typically continues to experience discomfort at the surface where the sleeper's body contacts the sleep surface.

Yet other devices provide for cooling the surface and the sleep environment by passing conditioned air through the surface of the bed, but require the use of a specialty bed having a configuration or thickness or rigidity unsuitable for use as a mattress topper. A sleeper who wants to use an existing bed or mattress, in this case, cannot do so.

SUMMARY OF THE INVENTION

A mattress topper for providing improved comfort to a sleeper comprises a pressure distribution layer defining an interior volume. The pressure distribution layer has substantially air-impermeable side walls and a substantially air-impermeable base, and a top surface having at least a region that is air permeable. The pressure distribution layer further comprises a support material contained within the interior volume, the support material having high air permeability and mechanical strength sufficient to substantially maintain separation of the top surface of the distribution layer from the base of the distribution layer when a sleeper lies upon the mattress topper. The mattress topper further comprises at least one air inlet port, and at least one electrically powered air circulation device for drawing air into the interior volume of the pressure distribution layer via the at least one air inlet port. A lateral air-flow layer is disposed above the pressure distribution layer and is configured to provide air flow both upwardly and laterally. In some embodiments the pressure distribution layer is configured to provide substantially unimpeded air flow both upwardly and laterally.

In some embodiments of the above-described mattress topper, the lateral air-flow layer comprises an air-permeable first surface, and an air-permeable second surface separated by substantially vertically oriented polymer fibers joined at one end to the first surface and at an opposite end to the second surface, the fibers spaced so as to allow air flow between the first surface and the second surface. In some embodiments the fibers are spaced so as to allow substantially unimpeded air flow between the first surface and the second surface.

In some embodiments of the above-described mattress toppers, the mattress topper further comprises a resilient comfort layer disposed between the pressure distribution layer and the lateral air-flow layer. The comfort layer has air passages extending through its thickness to allow air escaping from the pressure distribution layer to pass through the comfort layer substantially below the sleeper's body, while substantially preventing air flow not close to the sleeper's body.

In some embodiments of the above-described mattress toppers, the mattress topper further comprises a controller housed within the interior volume of the pressure distribution layer, for controlling operation of the air circulation device. In some embodiments the controller is configured for wireless communication. In some embodiments of the above-described mattress toppers, the mattress topper further comprises a manual control device, for controlling or adjusting operation of the mattress topper.

In some embodiments of the above-described mattress toppers, the at least one air circulation device is disposed within the interior volume of the pressure distribution layer. In some embodiments, an air circulation device is situated in each of four corner regions of the pressure distribution layer.

In some embodiments of the above-described mattress toppers, the mattress topper further comprises at least one heating element situated in the top surface of the pressure distribution layer.

In some embodiments of the above-described mattress toppers, the mattress topper further comprises at least one temperature sensor.

In some embodiments of the above-described mattress toppers, the mattress topper further comprises an air-permeable cover housing the pressure distribution layer and the lateral air-flow layer.

This summary does not necessarily describe the entire scope of all aspects. Other aspects, features, and advantages will be apparent to those of ordinary skill in the art upon review of the following description of specific embodiments.

BRIEF DESCRIPTION OF THE DRAWINGS

It is to be understood that the attached drawings are provided for the purpose of illustrating various embodiments and aspects of the present invention and may not be to scale.

DETAILED DESCRIPTION OF EMBODIMENTS OF THE INVENTION

Figure 1:
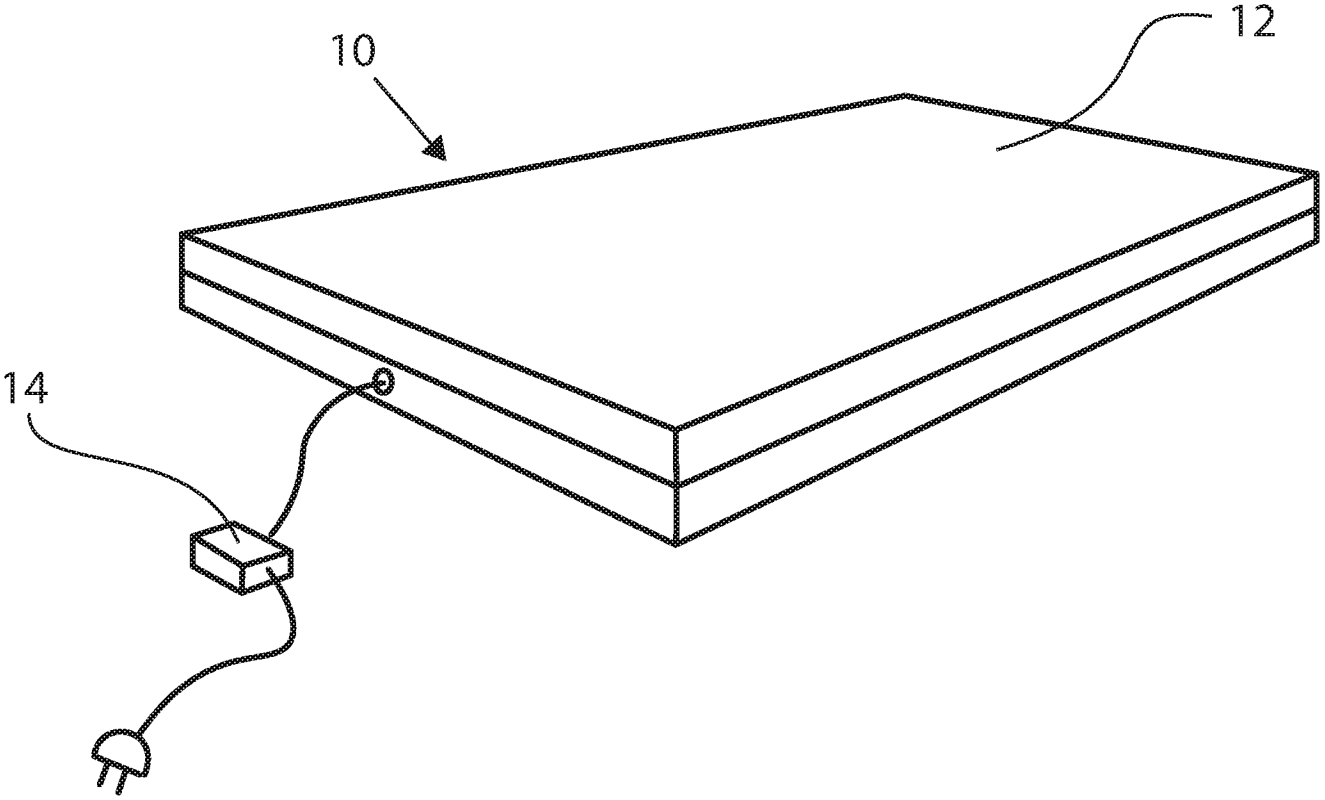
FIG. 1 is an isometric view illustrating an embodiment of an air-conditioned mattress topper.

Air-conditioned mattress toppers, as described herein, can be used for improving the temperature and humidity comfort of a sleeper and can be used in conjunction with the sleeper's existing mattress or bed. Some embodiments of such mattress toppers are sufficiently thin and conformable to be used on top of an existing mattress or bed without adversely affecting the physical comfort of the existing mattress or bed. In some embodiments, sufficiently thin means having a thickness less than 3 inches. In some embodiment, sufficiently thin means having a thickness less than about 2 inches. In some embodiment, the air-conditioned mattress topper has a thickness in the range of about 1 to 3 inches. In some embodiment, the air-conditioned mattress topper has a thickness in the range of about 1 to 2 inches. In some embodiments, sufficiently conformable means being so deformable and flexible so that perceived deformability of the underlying mattress is not significantly affected by the presence of the mattress topper.

Embodiments of the mattress toppers described herein comprise features that can address difficulties of achieving properly distributed air flow within a mattress topper, without the use of pipes or other somewhat rigid conduits, and without generating significant acoustic noise when creating a desired level of air flow. It can be challenging to achieve air flow and sufficiently uniform distribution of air flow within a thin mattress topper, for example, due to frictional losses. Addressing these issues by increasing air pressure is generally undesirable because the generation of the high air pressure by the use of fans or blowers can create a level of acoustic noise that disrupts sleep, and is therefore undesirable for sleepers. Embodiments of the mattress toppers described herein provide for well-distributed, low-pressure movement of air through the thin structure of the mattress topper without generating acoustic noise having a significant volume, or undesirable timbre. Low noise and well distributed flow can be accomplished by using highly permeable interior materials and by locating blowers so as to minimize or reduce the distance between the blowers and the sleeper's typical position where the air exits the mattress topper. Accordingly, in some embodiments blowers are located in the four corner regions of the mattress topper, outside the sleep area. In some embodiments blowers are located in just the two corners at the foot-end of the mattress topper. The blowers can also be suspended by foam structures and surrounded by foam structures, thus minimizing or reducing conduction of blower vibration and sound. Embodiments of the mattress toppers described herein can be used to provide cooling directly under the sleeper's body, and cooling in the sleep environment beneath the bedding that is normally covering the sleeper. This is accomplished by the forced distribution of air through the mattress topper, with some air passing directly beneath the sleeper's body cooling the surface contacting the sleeper's body, and at least some of the air being exhausted from the sleep environment carrying away heat and humidity. In some embodiments, the mattress topper also comprises heating elements for warming the sleep surface and sleep environment, for use in situations where the sleeper desires heating instead of cooling.

Thus, the air-conditioned mattress toppers described herein can be used to control or adjust the temperature of a sleep environment by moving conditioned forced air within and through the mattress topper. Embodiments of the mattress topper have air-conditioning, control, heating, and temperature sensing elements contained within an air-permeable cover. In use, the mattress topper is positioned on top of a mattress for providing cooling and/or heating of a sleeper who lies on the mattress topper. Preferably, the mattress topper has a thin thickness of two inches or less and is sufficiently pliable so as to not adversely affect the comfort of the underlying bed. Cooling is provided by movement of ambient air from outside the mattress topper, drawn into the mattress topper by electric blowers, such as Toyon TD7025k centrifugal blowers, or other suitable devices, such air passing within the mattress topper and eventually exiting through the upper surface of the mattress topper. In some embodiments, heating can be provided by heating the interior of the mattress topper by passing electric current through an array of heating wires embedded in the topper, so that the surface of the mattress topper achieves an elevated temperature. In some embodiments, the mattress topper comprises a lower layer, a comfort layer, an upper layer and, in some embodiments, an encasement or cover. The lower layer contains one or more air circulation devices, such as blowers, fans or pumps. These can be electrically powered and, in operation, draw air into the lower layer of the mattress topper and move the air within and through the lower layer. The lower layer is preferably structured so that the pressure within it is substantially equalized, for example, as described in further detail below. The comfort layer comprises a soft and/or resilient material with a plurality of air passages extending through the thickness of the material from one major surface to the other. In some embodiments, the comfort layer comprises a foam rubber material. In some embodiments, the upper layer comprises a three-dimensional structured textile configured to allow upward and lateral movement of air. The above-described layers and their components can be contained within an air-permeable encasement or cover. The cover can be, for example, a zippered cover that can be removed for cleaning, or to allow access to the components of the mattress topper that are housed therein.

The elements are configured to draw air at ambient temperature from the surrounding environment into the lower layer, pressurizing the lower layer substantially equally throughout the interior volume of the lower layer. The lower layer has a top surface that is somewhat air permeable. In some embodiments, a substantially impermeable comfort layer is positioned on the somewhat air-permeable top surface of the lower layer, and the comfort layer limits air flow except where air passages extending through the thickness of comfort layer provide for air to pass. The air passages are positioned so as to be substantially beneath the sleeper's body. The upper layer of the mattress topper is configured to allow air from the air passages to pass through the upper layer and, encountering the surface of the sleeper's body, to pass laterally within the upper layer to provide heating or cooling to the sleeper's body, and particularly the surface of sleeper's body that lies in contact with the top surface of the mattress topper. The air eventually exhausts into the sleep environment, further cooling those parts of the sleeper's body which do not contact the surface of the mattress topper, and finally exiting the sleep environment carrying heat and excess moisture from the sleep environment.

In some embodiments the air-conditioned mattress topper has an associated control system that responds to sensor inputs, algorithms and parameters to adjust the degree of heating and/or cooling that the mattress topper applies to the sleeper's body. The control system can provide sleep diagnostics (assessing quality of sleep) and may have learning algorithms that use sleep diagnostics to adjust heating and/or cooling controls so as to seek to maintain optimal sleep quality.

Referring now to the drawings FIG. 1 through FIG. 8, we describe an example embodiment of an air-conditioned mattress topper 10. Throughout the drawings, like reference numerals are used to denote the same or similar elements. FIG. 1 illustrates a mattress topper 10 comprising an air-permeable cover 12, and connected to a power supply 14 for providing electric power to the air-conditioning, control, heating, and temperature sensing elements contained within the mattress topper. In use, the mattress topper is positioned on top of a mattress for providing cooling and/or heating of a sleeper who lies on the mattress topper. Cooling is provided by movement of air from outside the mattress topper, into and through the mattress topper, and eventually exiting through the top surface of the mattress topper. Heating is optionally provided by the passing electrical current through heating wires embedded within the mattress topper, so that the surface of the mattress topper achieves an elevated temperature.

Figure 2:
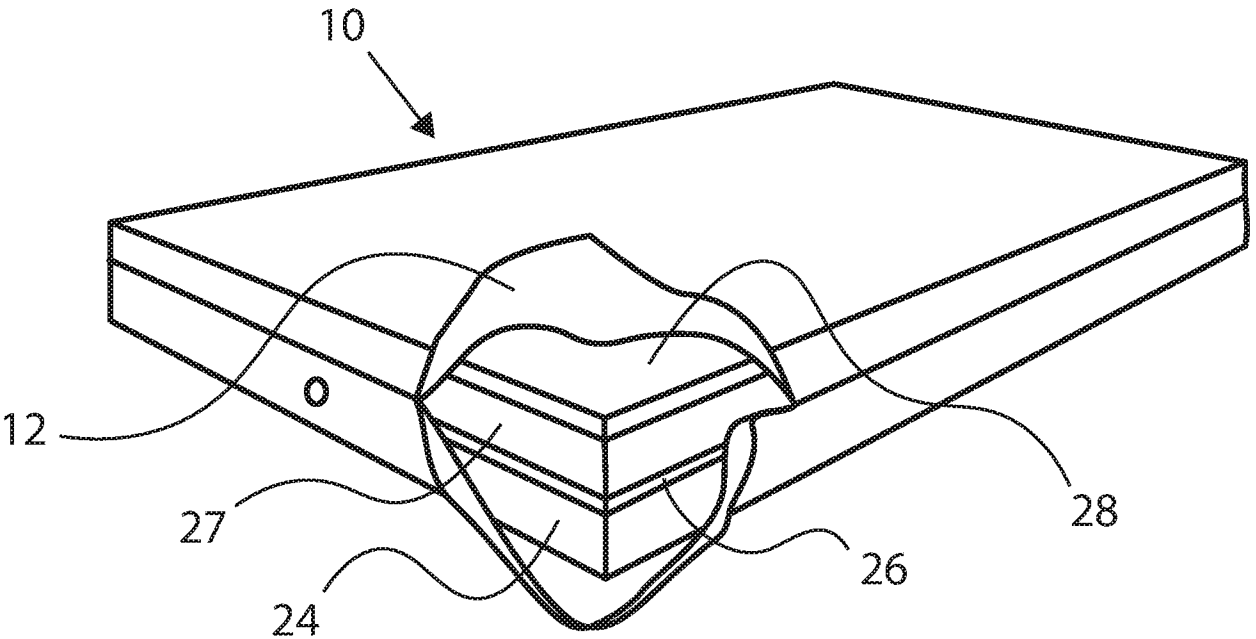
FIG. 2 is an isometric view with the outer cover opened up to illustrate the interior of an embodiment of an air-conditioned mattress topper showing various layers.

Referring now to FIG. 2, the interior layers of the mattress topper 10 which are visible when opening the permeable cover 12 are described. The interior layers of mattress topper 10 include a pressure distribution layer 24 positioned as a lower-most layer, and having four substantially air-impermeable side walls and a substantially air-impermeable base (not labelled), and a somewhat air-permeable top surface 26. Comfort layer 27 is positioned on top of pressure distribution layer 24, and can be, for example, constructed of foam rubber, such as foam commonly called memory foam. Comfort layer 27 generally provides two functions: improving the comfort of the sleeper by supporting and conforming to the shape of the sleeper, and directing air flow beneath the central area of the mattress topper where the sleeper will most likely be positioned. Situated as the upper layer is a lateral air-flow layer 28 that can comprise or be constructed as a three-dimensional structure having very high air permeability both vertically and laterally through the structure. In some embodiments the three-dimensional structure has a top and bottom surface consisting of a mesh or net-like fabric, and the top and bottom surfaces are separated by substantially vertically oriented polymer fibers of sufficient strength to generally maintain the separation of the top and bottom surface of the structure when burdened by weight of a sleeper. In one embodiment, permeable cover 12 is formed of three-dimensional structured fabric made of the same material as air-flow layer 28 described above, so as to provide combined function of permeable cover 12 and air-flow layer 28. In another embodiment, permeable cover 12 is an air-permeable conventional fabric having a knit or weave loose or open enough to provide for air to readily pass through it.

Figure 3:
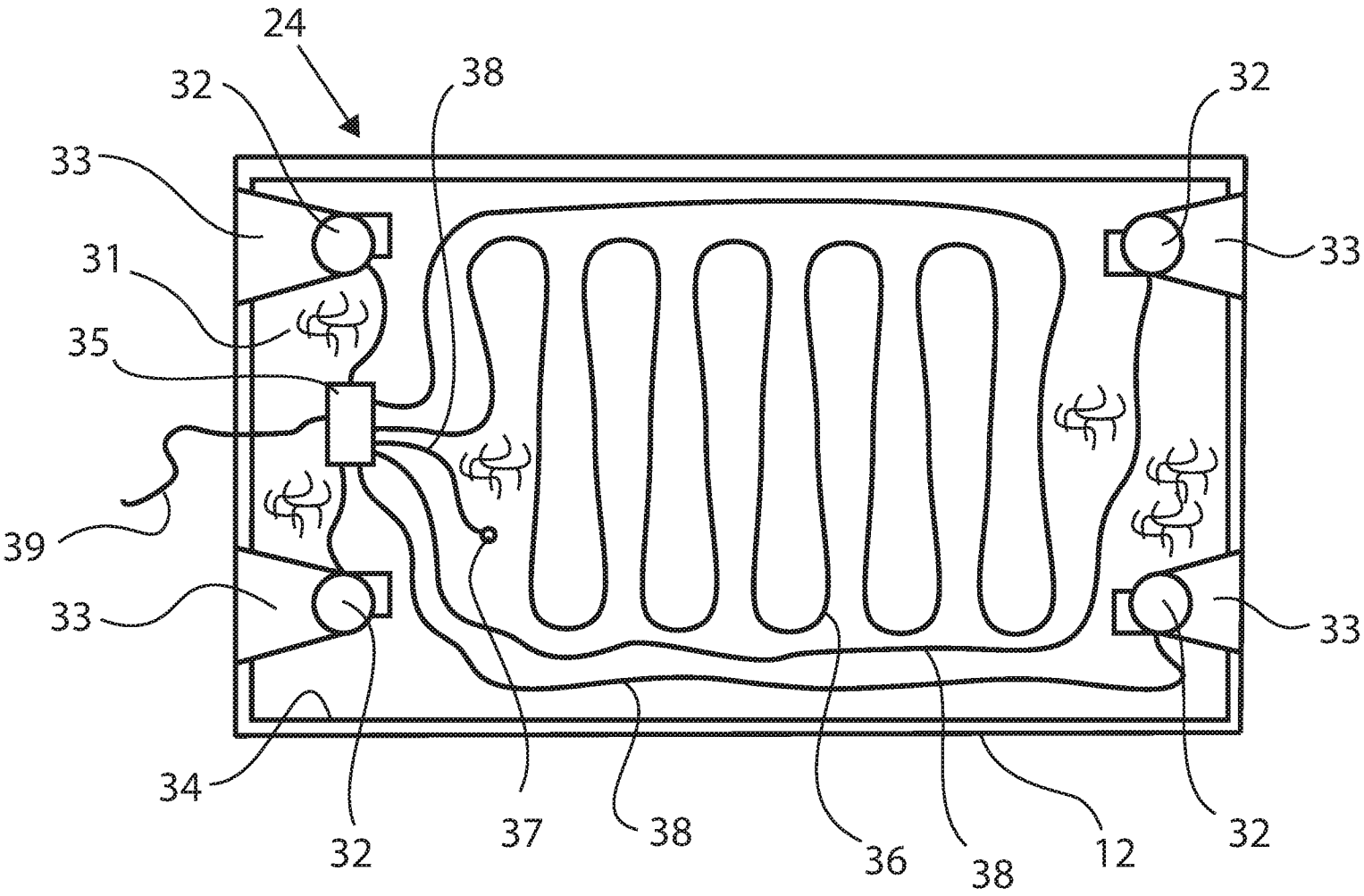
FIG. 3 illustrates the inside of a lower pressure distribution layer of an embodiment of an air-conditioned mattress topper.

Considering now the internal layers of the mattress topper 10, each in turn, FIG. 3 depicts interior components of pressure distribution layer 24. The external side walls and base 34 of pressure distribution layer 24 together with its air-flow restrictive top surface (shown as 26 in FIG. 2) contain and adequately maintain air pressure within pressure distribution layer 24. For example, the external sides and base 34 can be formed of a substantially air-impermeable textile or material. In order to maintain the interior volume of the pressure distribution layer 24 when loaded by a sleeper's body, a support material 31, such as a highly permeable fibrous polymer material, substantially fills the interior volume of pressure distribution layer 24. Support material 31 is shown in FIG. 3 in parts so as to avoid obscuring the depiction of other components, but in some embodiments it is a single piece of material substantially filling the interior volume of pressure distribution layer 24. Support material 31 can be adapted to accommodate the other hardware illustrated. In the some embodiments, for example, fibrous polymer material 31 is a three-dimensional spring-structured fiber such as described in Japanese patent JP4802369B2. Located within pressure distribution layer 24 is at least one blower, fan, pump or other suitable air circulation device 32 for drawing air into and moving it through pressure distribution layer 24. In some embodiments, pressure distribution layer 24 comprises four such air circulation devices. These can, for example, be located near the four corners of the pressure distribution layer, as shown in FIG. 3 for example. Air is drawn from the surroundings into pressure distribution layer 24 through air inlet ports 33 which can be formed in the side walls of pressure distribution layer 24. Air can be drawn through the air-permeable cover 12 if it covers air inlet ports 33.

A controller 35 is also located within the interior volume of pressure distribution layer 24. Controller 35 controls electrically powered components in the mattress topper, such as air circulation devices 32 and heating elements 36, and receives signals from at least one temperature sensor 37 and other sensors (not shown in FIG. 3) that can be used to monitor and manage the sleep quality of the sleeper. Other sensors may include accelerometers to measure movement of a sleeper. Air circulation devices 32, heating elements 36 and sensors 37 are connected to controller 35 by wires 38. In some embodiments, heating elements 36 are located on top of support material 31, and can be formed together with the top surface of pressure distribution layer 24 (shown as 26 in FIG. 2). Controller 35 receives electrical power through power cable 39.

Figure 4:
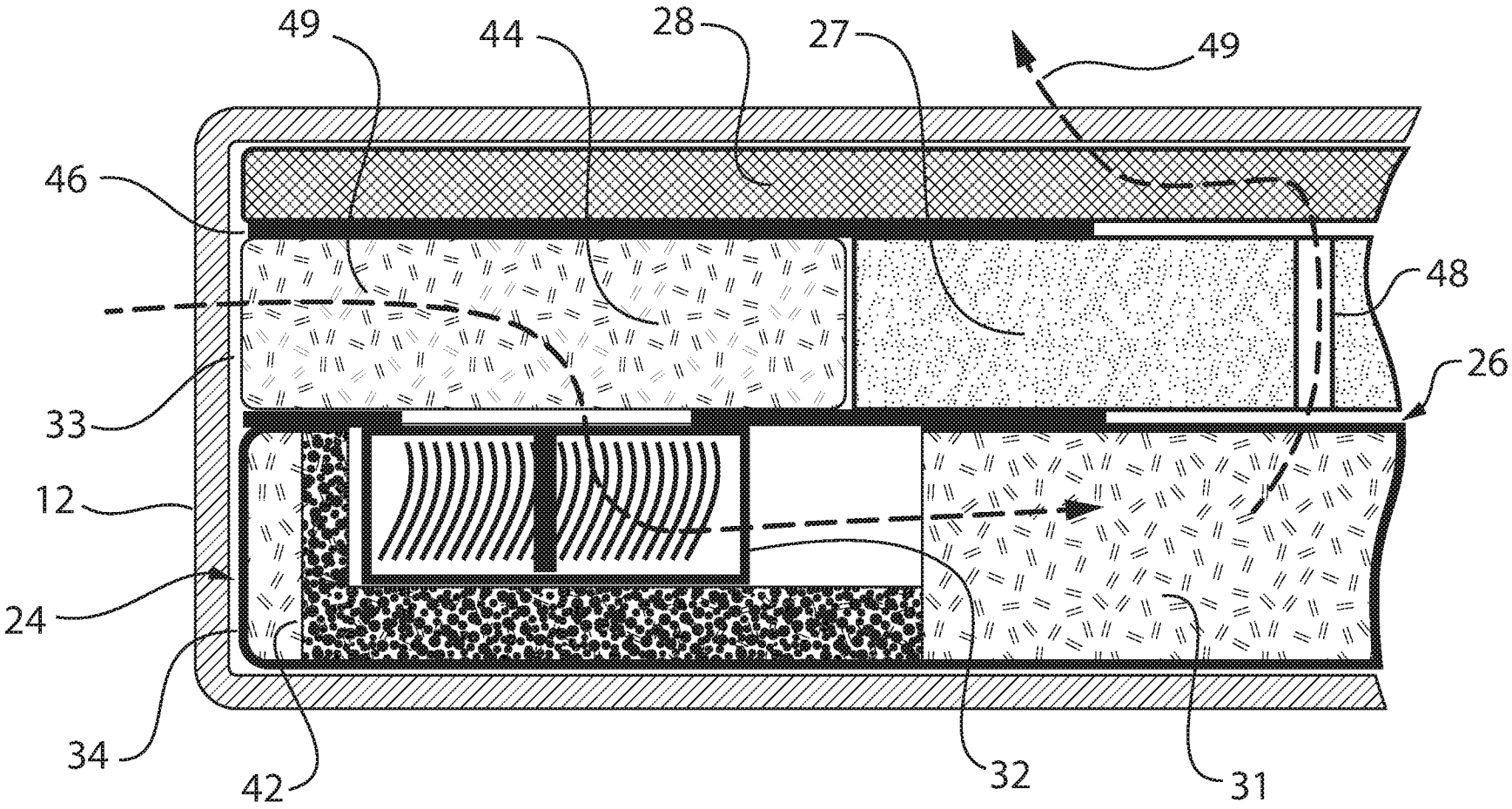
FIG. 4 is a cross-sectional side view illustrating an embodiment of an air circulation device and an air inlet port.

FIG. 4 depicts air circulation device 32 mounted in a structure of foam material 42 with vibration dampening properties to reduce the transmission of vibrations that may cause audible noise. The structure of foam material 42 has openings for air to enter and exit air circulation device 32. In one embodiment, the structure of foam material 42 comprises or consists of memory foam, but in other embodiments could comprise or consist of other types of vibration-dampening materials. In an embodiment of the mattress topper, structure of foam material 42 is contained within pressure distribution layer 24. Air inlet port 33 comprises a volume of highly permeable fibrous material 44 which has sufficient strength to maintain porosity even when subjected to the weight of a sleeper's body. In some embodiments, the permeable fibrous material 44 may be the same material as support material 31. Air inlet port 33 is adjacent to, and co-planar with, comfort layer 27. Above air inlet port 33 is a thin layer of non-permeable barrier material 46, which in some embodiments could be a non-porous textile or closed cell foam. Air flow is constrained by barrier material 46 and comfort layer 27 to be drawn through permeable cover 12 and into air inlet port 33 by air circulation device 32, and directed through a passage formed in the structure of foam material 42 into pressure distribution layer 24, where the air flows through very porous support material 31, and eventually through air passages 48 and finally through air-flow layer 28 and the top of permeable cover 12, as indicated by arrows 49.

Figure 5:
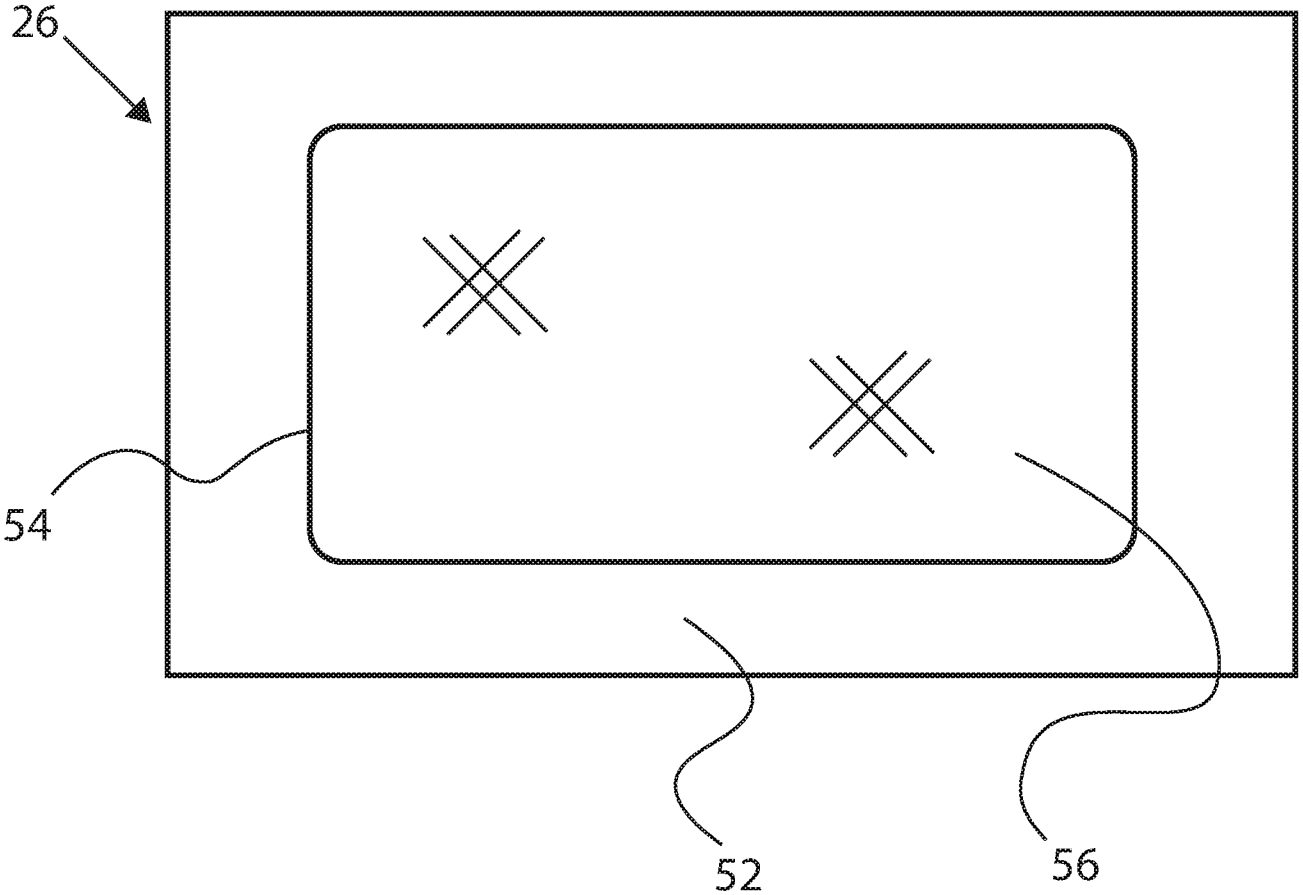
FIG. 5 is a plan view illustrating an embodiment of a top surface of a lower pressure distribution of an air-conditioned mattress topper.

FIG. 5 depicts, in plan view, an embodiment of top surface 26 of pressure distribution layer 24. Top surface 26 comprises an outer border formed of a substantially air-impermeable fabric 52 surrounding a sleep region 54, sleep region 54 formed of a somewhat air-permeable fabric 56. The air permeability of the somewhat permeable fabric 56 is chosen to allow some passage of air through it from the underlying interior volume of pressure distribution layer 24, and upwardly through the remaining layers of the mattress topper, but to be restrictive enough to maintain some pressure within pressure distribution layer 24. In other embodiments, the somewhat permeable fabric 56 can be an air-impermeable fabric perforated by a multiplicity of holes, the number and size of which are configured to allow air to exit the pressure distribution layer while maintaining some pressure within the pressure distribution layer. In other embodiments, comfort layer 27 of FIG. 2 can be integrated as the top surface of pressure distribution layer and provide flow restriction for air exiting pressure distribution layer.

Figure 6:
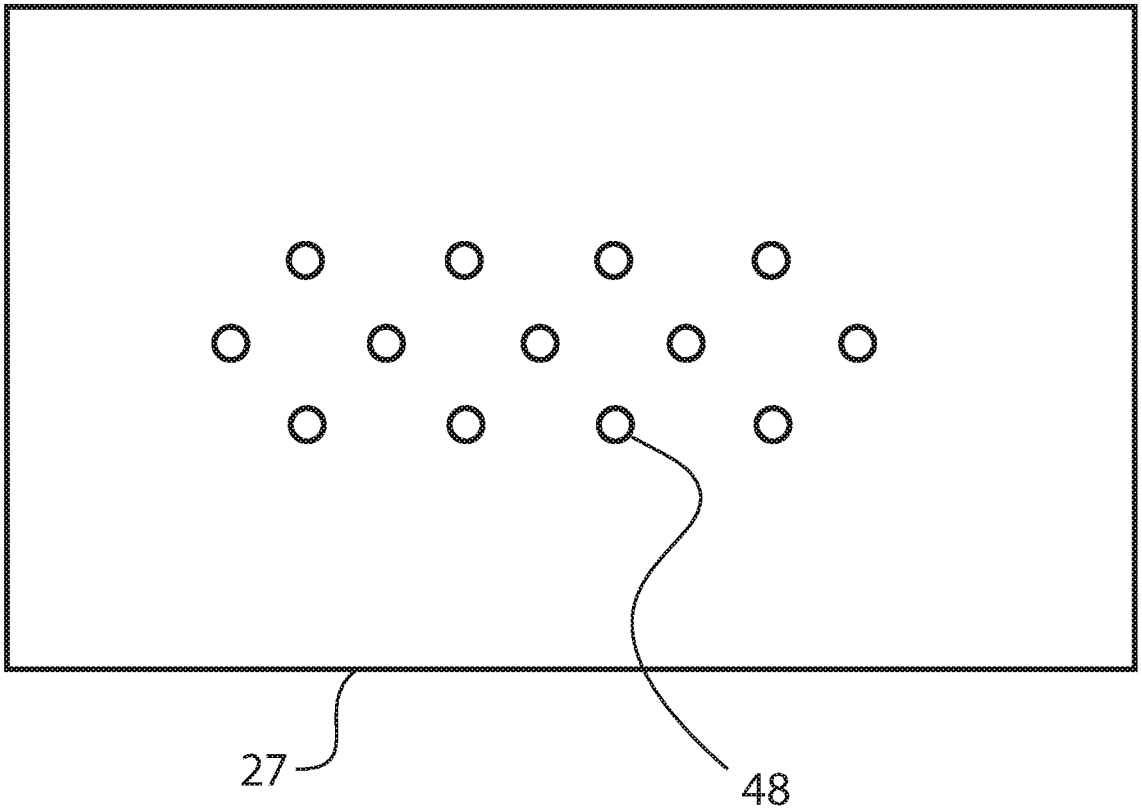
FIG. 6 is a plan view illustrating a comfort layer of an embodiment of an air-conditioned mattress topper.

FIG. 6 depicts an embodiment of comfort layer 27 which, in the some embodiments is memory foam comprising a multiplicity of air passages 48 (e.g. holes or perforations) which extend through the thickness of comfort layer 27, from one major surface to the other. In other embodiments, the comfort layer 27 could be air-permeable or perforated non-permeable foam generated from other rubber-like materials, such as latex, polyurethane, or various memory foams. Air passages 48 are configured to allow air flow from the pressure distribution layer 24 of FIG. 2 and sleep region 54 (shown in FIG. 5) of the top surface 26 of pressure distribution layer 24 upwards to a region of the overlying layer that is positioned below a sleeper. An object of air passages 48 is to direct air flow to the sleeper's body, and specifically the underside of the body that is in contact with the top surface of the mattress topper. In some embodiments, the thickness of comfort layer 27 is about 1 inch.

Figure 7:
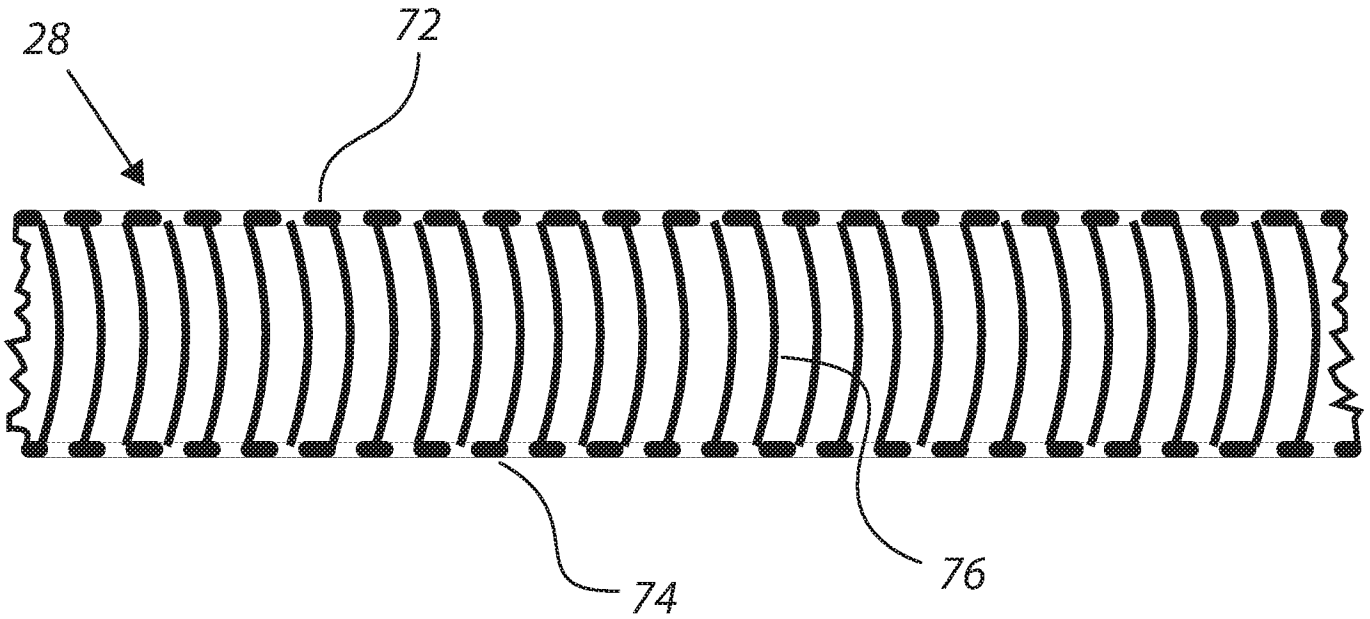
FIG. 7 is a cross-sectional magnified view illustrating a lateral air-flow layer of an embodiment of an air-conditioned mattress topper, the lateral air-flow layer having air-permeable features.

FIG. 7 depicts an embodiment of lateral air-flow layer 28 in cross-section. Lateral air-flow layer 28 comprises an air-permeable top surface 72 and air-permeable bottom surface 74 separated by polymer fibers 76. Polymer fibers 76 are configured to separate top surface 72 and bottom surface 74 and have sufficient strength and rigidity to maintain separation of top surface 72 from bottom surface 74 when loaded by the weight of a sleeper. Polymer fibers 76 are arranged to provide substantially free or unimpeded air movement upwardly through the thickness of lateral air-flow layer 28 and laterally between top surface 72 and bottom surface 74. In some embodiments, lateral air-flow layer 28 can comprise or consist of, for example, a three-dimensional mesh fabric such as described in Chinese patent CN200414680U.

Figure 8:
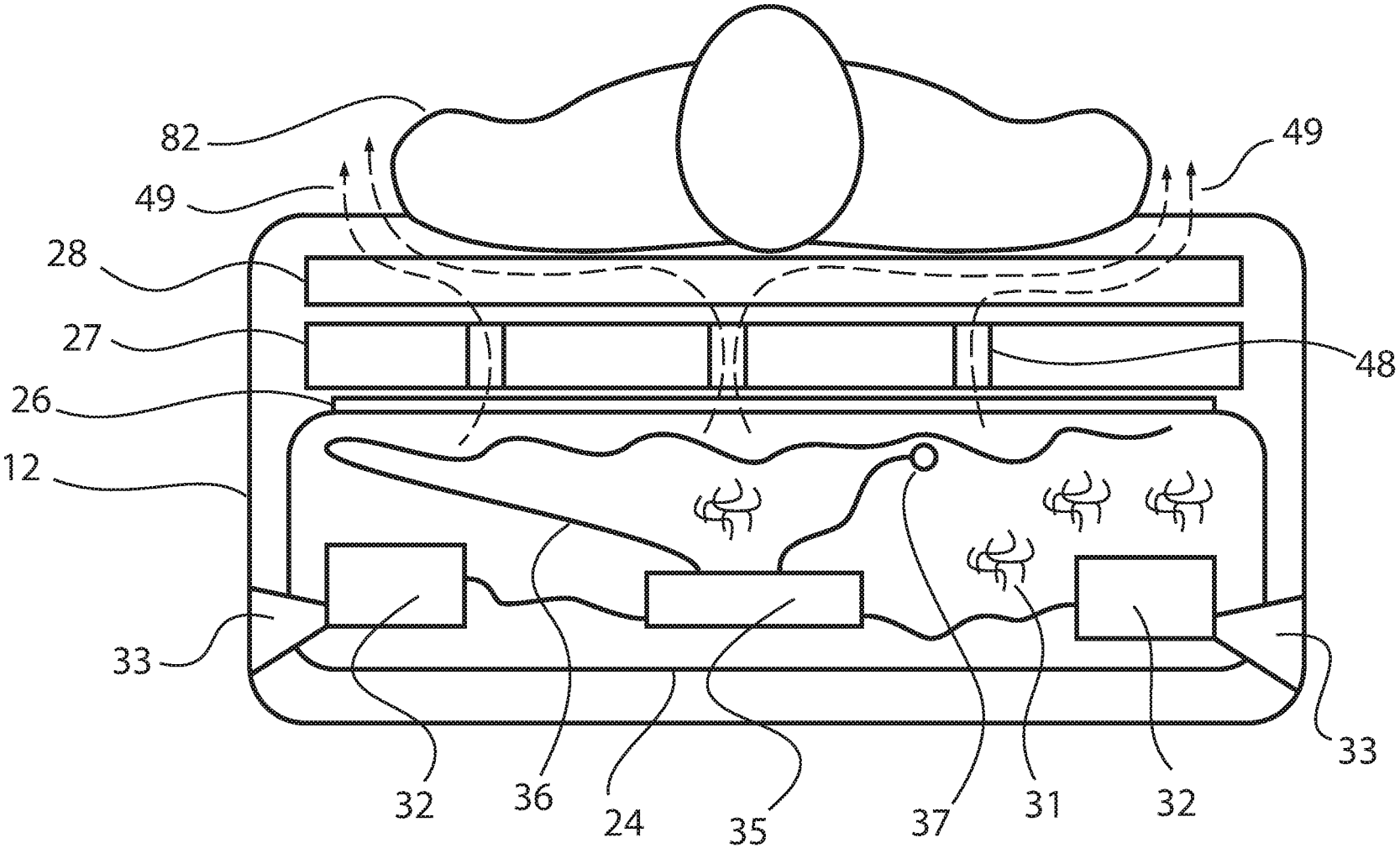
FIG. 8 is a schematic cross-sectional view illustrating various layers and elements of an embodiment of an air-conditioned mattress topper, showing schematically air flow through the layers.

FIG. 8 is a schematic illustration showing elements of a mattress topper, and shows (with dashed lines and arrows) the general operational flow pattern of air 49 flowing from pressure distribution layer 24 through the top surface 26 thereof, through comfort layer 27, through lateral air-flow layer 28 and contacting the surface of a sleeper's body 82. The internal layers of the mattress topper are separated in the drawing for clarity, but generally each layer lies upon the other in substantially intimate contact. In addition, some of the layers may be made up of several discrete layers or may be integrated into a single layer or piece of material to provide similar function. For example, the top surface 26 of pressure distribution layer 24 can be combined with comfort layer 27, or air-permeable cover 12 and lateral air-flow layer 28 can be combined. The drawing of FIG. 8 is not to scale and, for clarity, does not depict relative sizes of the elements. In operation, controller 35 controls operation of the air circulation device(s) 32 drawing air through air inlet port(s) 33, pressurizing the interior volume of pressure distribution layer 24. Controller 35 also controls operation of heating elements 36 which can be used to heat the top surface 26 of pressure distribution layer 24. Controller 35 can receive signals from one or more temperature sensors 37, and use these to influence operation of heating elements 36 and air circulation device(s) (32). Air escapes the pressurized pressure distribution layer 24 through the air-permeable sleep region 54 (FIG. 5) of top surface 26. Air escaping through top surface 26 of pressure distribution layer 24 flows through air passages 48 that penetrate the comfort layer 27. Air flowing through comfort layer 27 enters the lateral air-flow layer 28. Air flowing into the lateral air-flow layer may flow upwardly through the top surface of the lateral air-flow layer 28, or, if encountering a sleeper's body 82, may flow laterally to carry heat away from sleeper's body, eventually escaping into the surrounding sleep environment through the top surface of the air-permeable cover 12 and eventually exiting the sleep environment, carrying away heat and humidity.

Figure 9:
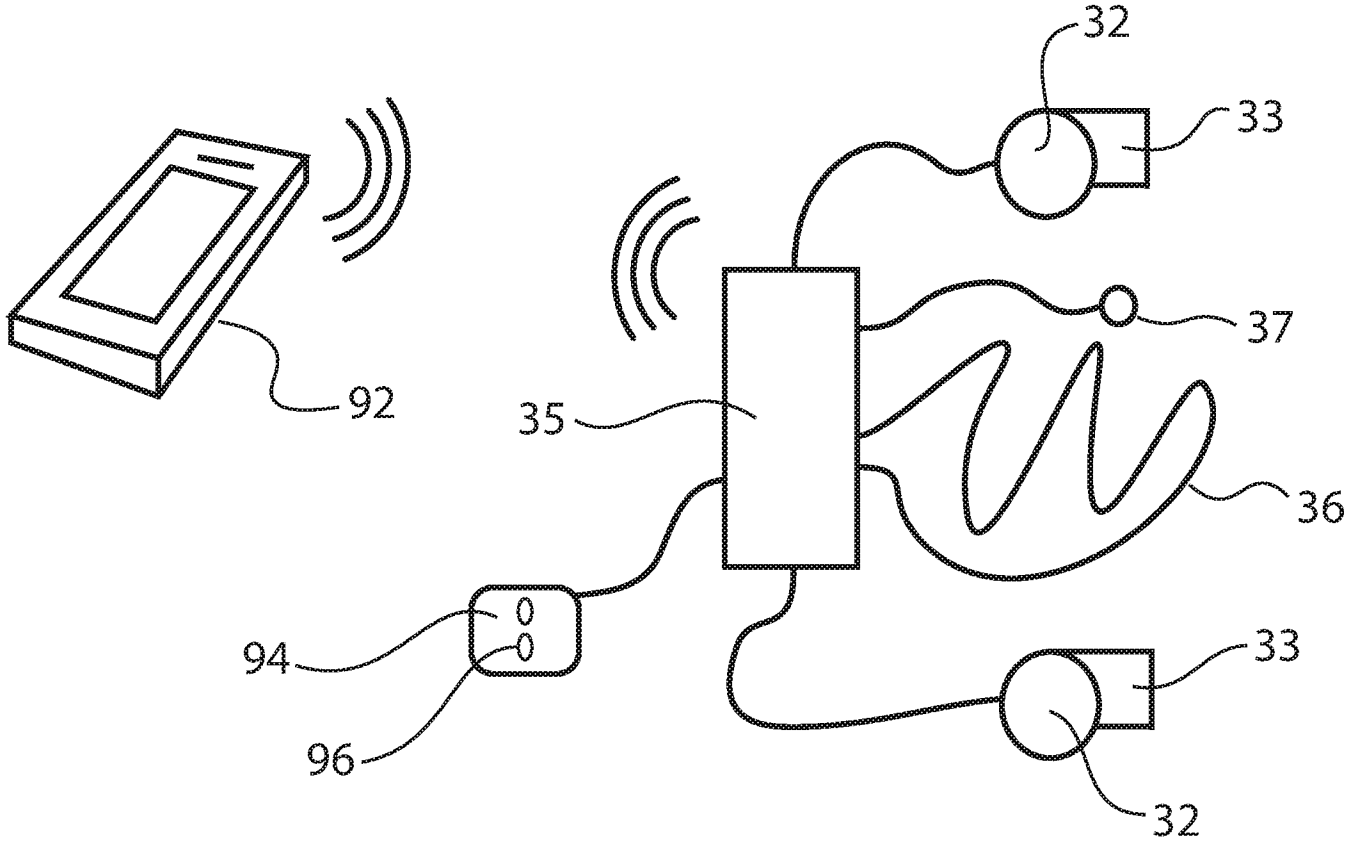
FIG. 9 illustrates a wireless communication device for communicating with a controller located within an air-conditioned mattress topper.

FIG. 9 depicts in schematic form a wireless communication device 92 for communicating with a controller (such as controller 35) located within an air-conditioned mattress topper, transmitting and receiving wireless signals to and from the controller. In some embodiments, the wireless signals are Bluetooth signals. In some embodiments, the wireless communication device 92 is a smart phone. In some embodiments, controller 35 controls air circulation device(s) 32 and heating elements 36 in response to wireless signals received via wireless communication device 92, and in response to signals received from at least one temperature sensor 37. In some embodiments, manual control device 94 having manual buttons 96 comprising electrical contact switches are connected to controller 35 by electrical wire. Manual control device 94 may be used to adjust one or more operational parameters of the mattress topper.

Figure 10:
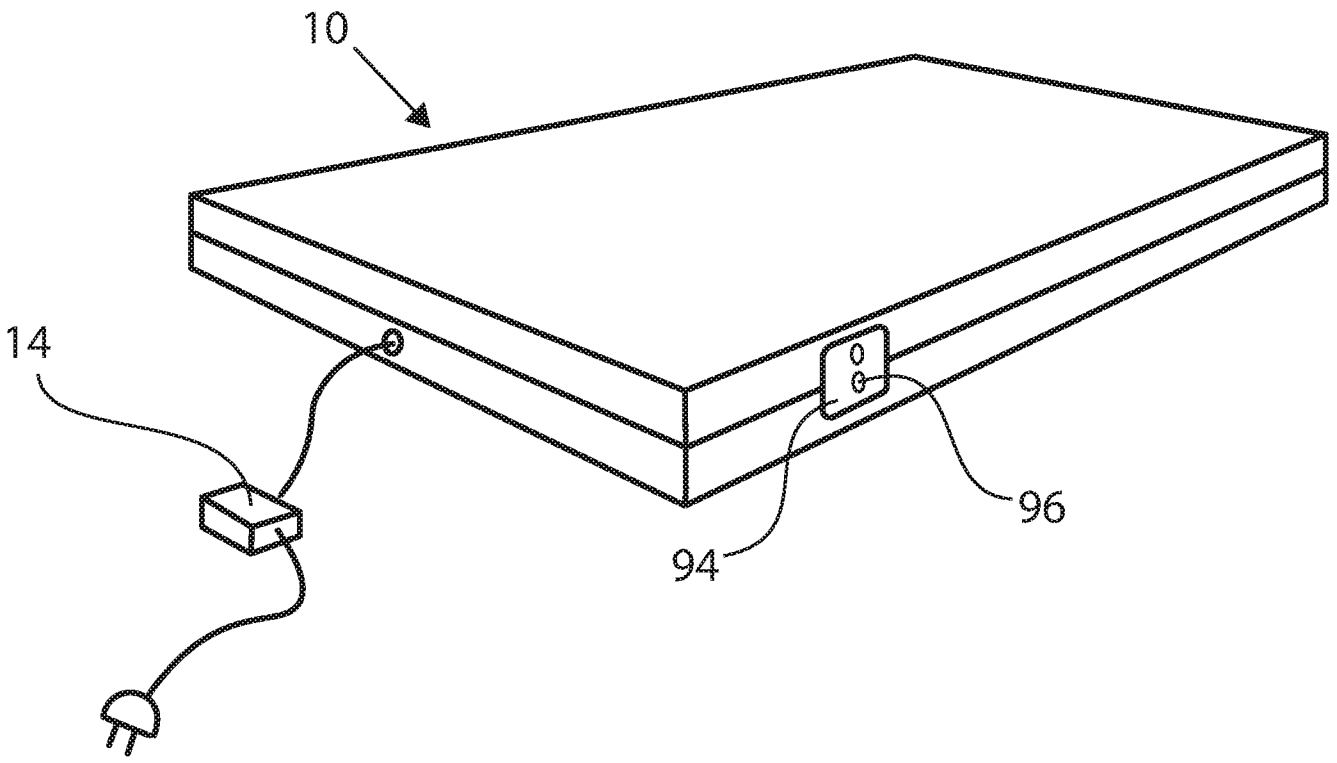
FIG. 10 is an isometric view illustrating an embodiment of an air-conditioned mattress topper with a manual control device.

In practice, controller 35 may automatically control the temperature of the mattress topper based on pre-programmed parameters, inputs from sensors and/or inputs from the sleeper. In some embodiments, the sleeper can affect inputs by operating communication device 92 to set operational modes, and to set operational parameters such as start time, end time, and baseline temperature. Controller 35, when configured in an automatic mode of operation, may begin controlling temperature of the mattress topper at the start time, and responding to temperature sensors 37, baseline temperature, and current time, adjust air circulation device(s) 32 and heating elements 36 in order to achieve a temperature in the mattress topper that is related to the baseline temperature set by the sleeper. In another mode of operation, the sleeper may control the temperature directly without automatic controls and may directly adjust the temperature using communication device 92, or by operating manual buttons 96 on manual control device 94 connected to controller 35 and accessible from the outside surface of the mattress topper 10, as shown in FIG. 10. Use of the manual control device 94 allows some control of the mattress topper without the sleeper having to use communication device 92.

In some situations, separate mattress toppers (each housed in a separate an air-permeable cover) can be placed side by side on one bed. For example, two single- or twin-sized mattress toppers can be place side-by-side on a king bed. In some embodiments of the mattress toppers described herein, individual mattress toppers can be produced in various sizes to fit different sizes of bed (for example, a single, twin, double, queen or king bed). Mattress toppers for larger beds may have additional blowers, heating elements, temperature sensors, and the like, relative to mattress toppers for smaller beds. In some embodiments, for beds that accommodate two sleepers, operating parameters for each side of the mattress topper can be independently controlled. In some embodiments, the mattress topper has two portions internally (each with its own pressure distribution layer having an air-flow restrictive top surface), but with a combined lateral air-flow layer overlying both pressure distribution layers, and an optional shared comfort layer disposed between the side-by-side pressure distribution layers and the combined lateral air-flow layer, all housed in an air-permeable cover.

It is contemplated that part of any aspect or embodiment discussed in this specification can be implemented or combined with part of other aspects or embodiments discussed in this specification.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A mattress topper for providing improved comfort to a sleeper comprising, a. a pressure distribution layer defining an interior volume, said pressure distribution layer having substantially air-impermeable side walls and a substantially air-impermeable base, and a top surface having at least a region that is air-permeable, said pressure distribution layer further comprising:

i. a support material contained within said interior volume, said support material having air permeability and mechanical strength sufficient to substantially maintain separation of said top surface of said distribution layer from said base of said distribution layer when a sleeper lies upon said mattress topper; and ii. at least one air inlet port;

b. a lateral air-flow layer disposed above said pressure distribution layer, said lateral air-flow layer configured to allow air flow both upwardly and laterally, wherein said lateral air-flow layer comprises a three-dimensional structured fabric comprising an upper layer of mesh fabric and a lower layer of mesh fabric, said upper and lower layers of mesh fabric separated by a fibrous polymer material;

c. a resilient comfort layer disposed between said pressure distribution layer and said lateral air-flow layer, said comfort layer having air passages extending through the thickness thereof to allow air escaping from said pressure distribution layer to pass through said comfort layer substantially below said sleeper's body; and d. at least one electrically powered air circulation device configured to draw air into said interior volume of said pressure distribution layer via said respective at least one air inlet port, and to move air upwardly through said air passages in said resilient comfort layer into said lateral air-flow layer, then through said lateral air-flow layer upwardly and laterally underneath and in contact with said sleepers body.

2. The mattress topper of claim 1 wherein said support material in said pressure distribution layer allows substantially unimpeded air flow both upwardly and laterally.

3. The mattress topper of claim 1 wherein said fibrous polymer material in said lateral air-flow layer comprises substantially vertically oriented polymer fibers joined at one end to said upper layer of mesh fabric and at an opposite end to said lower layer of mesh fabric surface, said fibers spaced so as to allow substantially unimpeded air flow both upwardly and laterally within said lateral air-flow layer.

4. The mattress topper of claim 1 wherein said resilient comfort layer is a foam layer.

5. The mattress topper of claim 1 further comprising a controller housed within said interior volume of said pressure distribution layer, for controlling operation of said air circulation device.

6. The mattress topper of claim 5 wherein said controller is configured for wireless communication.

7. The mattress topper of claim 1 wherein said at least one electrically powered air circulation device is disposed within said interior volume of said pressure distribution layer.

8. The mattress topper of claim 7 wherein said at least one electrically powered air circulation device comprises four electrically powered air circulation devices disposed within said interior volume of said pressure distribution layer, wherein said four electrically powered air circulation devices are situated with one in each of four corner regions of said pressure distribution layer.

9. The mattress topper of claim 1, further comprising at least one heating element situated in said top surface of said pressure distribution layer.

10. The mattress topper of claim 1, further comprising at least one temperature sensor.

11. The mattress topper of claim 1, further comprising an air-permeable cover, said air-permeable cover housing said pressure distribution layer and said lateral air-flow layer.

12. The mattress topper of claim 1, further comprising a manual control device integrated with and located at an edge of said mattress topper towards one end, reachable by a sleeper lying atop said mattress topper for adjusting one or more operational parameters of said mattress topper.

13. The mattress topper of claim 1 wherein said three-dimensional structured fabric allows substantially unimpeded air flow both upwardly and laterally within said lateral air-flow layer.

14. The mattress topper of claim 1 wherein said at least one electrically powered air circulation device comprises two electrically powered air circulation devices disposed within said interior volume of said pressure distribution layer, wherein said two electrically powered air circulation devices are situated with one in each of two adjacent corner regions of said pressure distribution layer.

15. The mattress topper of claim 1 wherein said mattress topper has a thickness in the range of about 1 to 3 inches.

16. The mattress topper of claim 15 wherein said mattress topper has a thickness in the range of about 1 to 2 inches.

17. The mattress topper of claim 15 wherein said comfort layer has a thickness of about 1 inch.

18. The mattress topper of claim 15 further comprising a controller housed within said mattress topper, for controlling operation of said air circulation device.

19. The mattress topper of claim 15 wherein said mattress topper is sufficiently deformable and flexible that deformability of an underlying mattress is not significantly affected by the presence of said mattress topper on top of said mattress.

* * * * *